US010669952B2

(12) United States Patent
Ulstad et al.

(10) Patent No.: US 10,669,952 B2
(45) Date of Patent: Jun. 2, 2020

(54) DIESEL ENGINE CYLINDER CUTOUT CONTROL SYSTEM FOR REDUCTION OF WHITE SMOKE PRODUCTION

(71) Applicant: Caterpillar Inc., Deerfield, IL (US)

(72) Inventors: James Ulstad, Edwards, IL (US); Laura Huhn, Chillicothe, IL (US); Blake Landon Smith, Princeville, IL (US); Samuel Were, Peoria, IL (US); Anand KrishnamurthyGopalan, Edwards, IL (US); Aaron D. Sollars, Dunlap, IL (US); Andrew Anderson, Knoxville, IL (US); Delon R. Reyhart, Dunlap, IL (US); Brooke A. Hart, Beverly Hills, MI (US)

(73) Assignee: Caterpillar Inc., Peoria, IL (US)

( * ) Notice: Subject to any disclaimer, the term of this patent is extended or adjusted under 35 U.S.C. 154(b) by 68 days.

(21) Appl. No.: 16/014,706

(22) Filed: Jun. 21, 2018

(65) Prior Publication Data

US 2019/0390610 A1 Dec. 26, 2019

(51) Int. Cl.

| | |
|---|---|
| ***F02D 17/02*** | (2006.01) |
| ***F02D 41/30*** | (2006.01) |
| ***F02D 41/26*** | (2006.01) |
| ***F02D 41/38*** | (2006.01) |

(52) U.S. Cl.

CPC ..... *F02D 17/02* (2013.01); *F02D 41/26* (2013.01); *F02D 41/3076* (2013.01); *F02D 41/38* (2013.01); *F02D 2041/389* (2013.01); *F02D 2200/0414* (2013.01); *F02D 2200/0611* (2013.01); *F02D 2200/101* (2013.01)

(58) Field of Classification Search

CPC ..... F02D 17/02; F02D 41/26; F02D 41/3076; F02D 41/38; F02D 2041/389; F02D 2200/0414; F02D 2200/0611; F02D 2200/101

USPC ..... 123/294, 481, 325, 332, 198 F; 701/112

See application file for complete search history.

(56) References Cited

U.S. PATENT DOCUMENTS

| | | | |
|---|---|---|---|
| 5,195,485 | A | 3/1993 | Jensen et al. |
| 5,868,116 | A | 2/1999 | Betts et al. |
| 6,009,857 | A | 1/2000 | Hasler et al. |

(Continued)

FOREIGN PATENT DOCUMENTS

| | | | |
|---|---|---|---|
| DE | 102009037294 | A1 | 2/2011 |
| WO | 2008071670 | A1 | 6/2008 |

*Primary Examiner* — Mahmoud Gimie

(74) *Attorney, Agent, or Firm* — Miller, Matthias & Hull

(57) ABSTRACT

A cylinder cutout system for an internal combustion engine is provided. The system may include a plurality of cylinders having a first pattern of cylinders and a second pattern of cylinders. Additionally, a fuel governor operatively coupled to a plurality of fuel injectors may regulate an amount of fuel received by the plurality of cylinders. The system may further include a plurality of sensors configured to collect a set of engine data and a controller communicably coupled with the plurality of fuel injectors, the fuel governor and the plurality of sensors. The controller may be programmed to detect a start-up condition of the engine and to execute a cylinder test cycle on at least a portion of the plurality of cylinders based on a positive detection of the start-up condition. The controller may activate one of the first or second patterns of cylinders based on the cylinder test cycle results.

20 Claims, 7 Drawing Sheets

(56) References Cited

U.S. PATENT DOCUMENTS

| | | | | |
|---|---|---|---|---|
| 6,763,807 | B1 | 7/2004 | Gilles et al. | |
| 9,051,874 | B2 | 6/2015 | Springer et al. | |
| 9,234,475 | B2 | 1/2016 | Gwidt et al. | |
| 9,587,567 | B2 | 3/2017 | Mahadevan et al. | |
| 2008/0312785 | A1* | 12/2008 | Hartmann | F02D 17/02 701/29.1 |
| 2009/0133662 | A1* | 5/2009 | Hartmann | F02D 17/02 123/198 DC |
| 2015/0136082 | A1* | 5/2015 | Younkins | F02D 41/0087 123/406.44 |
| 2016/0108798 | A1* | 4/2016 | VanDerWege | F02D 41/0087 60/602 |
| 2016/0252033 | A1 | 9/2016 | Dye et al. | |
| 2017/0130630 | A1* | 5/2017 | Younkins | F01N 3/0814 |
| 2017/0204802 | A1 | 7/2017 | Sixel et al. | |
| 2018/0051635 | A1* | 2/2018 | Mantovano | F02B 37/00 |
| 2018/0216562 | A1* | 8/2018 | Dudar | F02D 13/06 |

* cited by examiner

DIESEL ENGINE CYLINDER CUTOUT CONTROL SYSTEM FOR REDUCTION OF WHITE SMOKE PRODUCTION

TECHNICAL FIELD

The present disclosure relates generally to internal combustion engines, and more particularly, to systems and methods for controlling and operating engines to reduce white smoke production on start up.

BACKGROUND

Internal combustion engines, or more particularly, diesel engines, may be used to power various different types of machines, such as standby power generators, power plants, on-highway trucks or vehicles, off-highway machines, earth-moving equipment, aerospace vehicles, locomotives, marine vessels, and the like. Internal combustion engines such as diesel engines are typically supplied with a mixture of air and fuel, which is ignited at specific timing intervals using controlled injection of fuel into the combustion chamber. There are various ongoing efforts to reduce emissions as well as to improve efficiency, reliability and overall productivity of internal combustion engines. In diesel engines, another common goal is to reduce unburned hydrocarbon production (i.e., white smoke) that may occur due to poor or incomplete combustion.

Furthermore, in cold ambient conditions starting internal combustion engines using diesel as the primary fuel source presents a challenge to the ongoing efforts to reduce emissions. In these conditions, the diesel engine may have several cylinders that do not completely and/or efficiently combust the diesel fuel injected into the cylinder until a full load is applied to the engine or the engine warms up to normal operating temperature. As a result, the engine may operate under uncontrollable and unfavorable engine conditions which produce increased vibrations, increased noise, undesirable exhaust gas production, incomplete hydrocarbon production, increased particulates and the like. In order to reduce or prevent production of undesirable exhaust gas a control system for operating an internal combustion engine is needed which can quickly test the cylinders and shut down inactive cylinders or cylinders that may be operating under reduced loads.

One option is to eliminate fuel from one half of the cylinders on a timed basis as disclosed in U.S. Pat. No. 5,195,485 (hereinafter "'495 patent"). Specifically, the '495 patent discloses an engine with two banks of cylinders and a control assembly which senses when the engine is at idle speed and disables or overrides the normal fuel supply control mechanism and operates the fuel supply mechanism on an alternating basis. As a result, fuel supply to one cylinder bank is ceased and the fuel which would otherwise be supplied to both banks of cylinders is supplied to the other of the cylinder banks on a timed alternating basis. Although the '495 patent may provide some benefits, there is still room for improvement. For instance, the '495 patent discloses that the timer is activated when the engine is operating in an idle state and during a cold-start condition. Moreover, the timer control of the '495 patent only alternates fuel delivery between cylinder banks, it does not select a cylinder bank to test and then deactivate one of the cylinder banks based off the test results.

In view of the foregoing disadvantages associated with conventional ignition systems and devices, a need exists for responsive testing and control strategies for internal combustion engines that not only deactivate underperforming cylinders during a cold-start condition to reduce the production of undesired exhaust gas, but also incorporate testing strategies that seek to even out wear between cylinders during execution of such testing and control strategies The present disclosure is directed at addressing one or more of the deficiencies and disadvantages set forth above. However, it should be appreciated that the solution of any particular problem is not a limitation on the scope of this disclosure or of the attached claims except to the extent expressly noted.

SUMMARY OF THE DISCLOSURE

In one aspect of the present disclosure, a cylinder cutout system for an internal combustion engine in provided. The cylinder cutout system may include a plurality of cylinders of the internal combustion engine, and a first pattern of cylinders and a second pattern of cylinders each defined from the plurality of cylinders. The cylinder cutout system may further include a plurality of fuel injectors operatively coupled with the plurality of cylinders such that each cylinder of the plurality of cylinders includes at least one fuel injector. Moreover, a fuel governor may be operatively coupled with the plurality of fuel injectors and configured to regulate an amount of fuel received by each fuel injector of the plurality of fuel injectors and injected into the plurality of cylinders. A plurality of sensors may be operatively coupled to the internal combustion engine and configured to collect a set of engine data. Additionally, the cylinder cutout system may include a controller communicably coupled with the plurality of fuel injectors, the fuel governor and the plurality of sensors, wherein the controller is programmed to detect a start-up condition of the internal combustion engine based on one or more signals included in the set of engine data received from the plurality of sensors, wherein the controller is programmed to execute a cylinder test cycle on at least a portion of the plurality of cylinders based on a positive detection of the start-up condition, and wherein the controller is programmed to activate one of the first pattern of cylinders or the second pattern of cylinders and deactivate the other one of the first pattern of cylinders or the second pattern of cylinders based on the results of the cylinder test cycle.

In another aspect of the present disclosure, a method of controlling a cylinder cutout system for an internal combustion engine is provided. The method may include receiving one or more feedback signals from a plurality of sensors operatively coupled to the internal combustion engine, analyzing the feedback signals for one or more engine operating conditions, determining whether the internal combustion engine is operating in a start-up condition based on analysis of the feedback signals, testing one of a first pattern of cylinders or a second pattern of cylinders defined from the plurality of cylinders of the internal combustion engine, determining an operational condition of the tested first pattern of cylinders or the second pattern of cylinders, and selectively activating one of the first pattern of cylinders or the second pattern of cylinders and deactivating the other one of the first pattern of cylinders or the second pattern of cylinders based on the operational condition determined from the tested first pattern of cylinders or the second pattern of cylinders.

In yet another aspect of the present disclosure, an operational control system for internal combustion engine including a plurality of cylinders is provided. The control system may include a plurality of fuel injectors operatively coupled with the plurality of cylinders such that each cylinder of the plurality of cylinders includes at least one fuel injector. The system may further include a fuel governor operatively coupled with the plurality of fuel injectors and configured to regulate an amount of fuel received by each fuel injector and injected into each cylinder of the plurality of cylinders. A plurality of sensors, including at least one of an engine speed sensor, a fuel sensor, an engine coolant temperature sensor, and an inlet air manifold temperature sensor, the plurality of sensors are operatively coupled to the internal combustion engine and configured to collect a set of engine data. The system may further include a first pattern of cylinders and a second pattern of cylinders each defined from the plurality of cylinders, and a controller communicably coupled with the plurality of fuel injectors, the fuel governor, and the plurality of sensors. Wherein the controller is programmed to detect a start-up condition of the internal combustion engine based on one or more signals included in the set of engine data received from the plurality of sensors, wherein the controller is programmed to execute a cylinder test cycle on at least a portion of the plurality of cylinders based on a positive detection of the start-up condition, and wherein the controller is programmed to activate one of the first pattern of cylinders and the second pattern of cylinders and to deactivate the remaining one of the first pattern of cylinders or the second pattern of cylinders based on the results of the cylinder cycle test.

These and other aspects and features will be more readily understood when reading the following detailed description in conjunction with the accompanying drawings.

While the following detailed description is given with respect to certain illustrative embodiments, it is to be understood that such embodiments are not to be construed as limiting, but rather the present disclosure is entitled to a scope of protection consistent with all embodiments, modifications, alternative constructions, and equivalents thereto.

DETAILED DESCRIPTION

Figure 1:
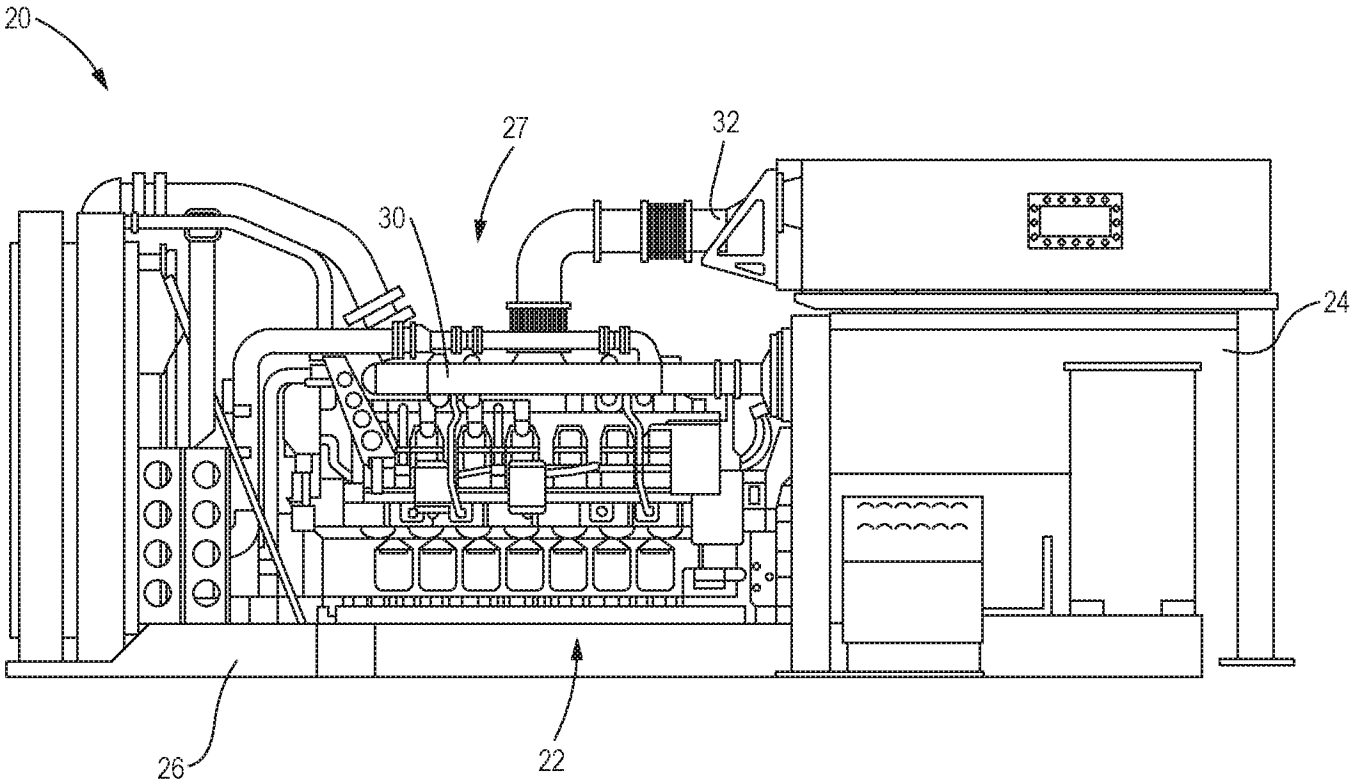
FIG. 1 is a side view of an exemplary power generator constructed in accordance with the teachings of the present disclosure.

Referring to FIG. 1, a side view of an exemplary power generator 20 including an internal combustion engine 22 is provided. The internal combustion engine 22 may be a diesel engine which uses air compression and ignition of fuel that is injected into a portion of the internal combustion engine 22 to generate mechanical power such as rotational torque output and the like. As such, the internal combustion engine 22 may be operatively coupled to a generator 24 and the mechanical power produced by the internal combustion engine 22 may be utilized by the generator 24 to produce electricity. Moreover, the power generator 20 may include a base or frame 26 to which the internal combustion engine 22, the generator 24 and other components may be supported, secured and/or otherwise mounted to. While FIG. 1 shows the internal combustion engine 22 incorporated into the power generator 20, it will be understood that the internal combustion engine 22 may similarly be incorporated with on-highway trucks or vehicles, off-highway machines, earth-moving equipment, aerospace vehicles, locomotives, marine vessels, and the like. Furthermore, an embodiment of the power generator 20 may incorporate additional mechanical power generators such as gasoline combustion engines, natural gas engines or any combination thereof.

As further shown in FIG. 1, the internal combustion engine 22 may include a plurality of cylinders 27 (e.g., six cylinders) to generate the desired mechanical power (i.e., rotational torque). Accordingly, the size and total number of the plurality of cylinders 27 included in the internal combustion engine 22 may be based on a desired or anticipated power output requirement. The internal combustion engine 22 may further include an air intake system 30 and air exhaust system 32 for handling engine air requirements. More specifically, the air intake system 30 may be configured to direct an incoming air supply from the external environment to the internal combustion engine 22. As such, the air supplied by the air intake system 30 may be combined with fuel that is injected the internal combustion engine 22. Furthermore, the air exhaust system 32 defines a pathway that is fluidly coupled with the plurality of cylinders 27 such that fuel combustion by-products (i.e., exhaust gas) may be directed away from the combustion chamber 34 and expelled from the internal combustion engine 22 into the surrounding environment. Moreover, the air exhaust system 32 may be configured to treat the fuel combustion by-products to reduce and/or remove contaminants before being released into the surrounding environment.

Figure 2:
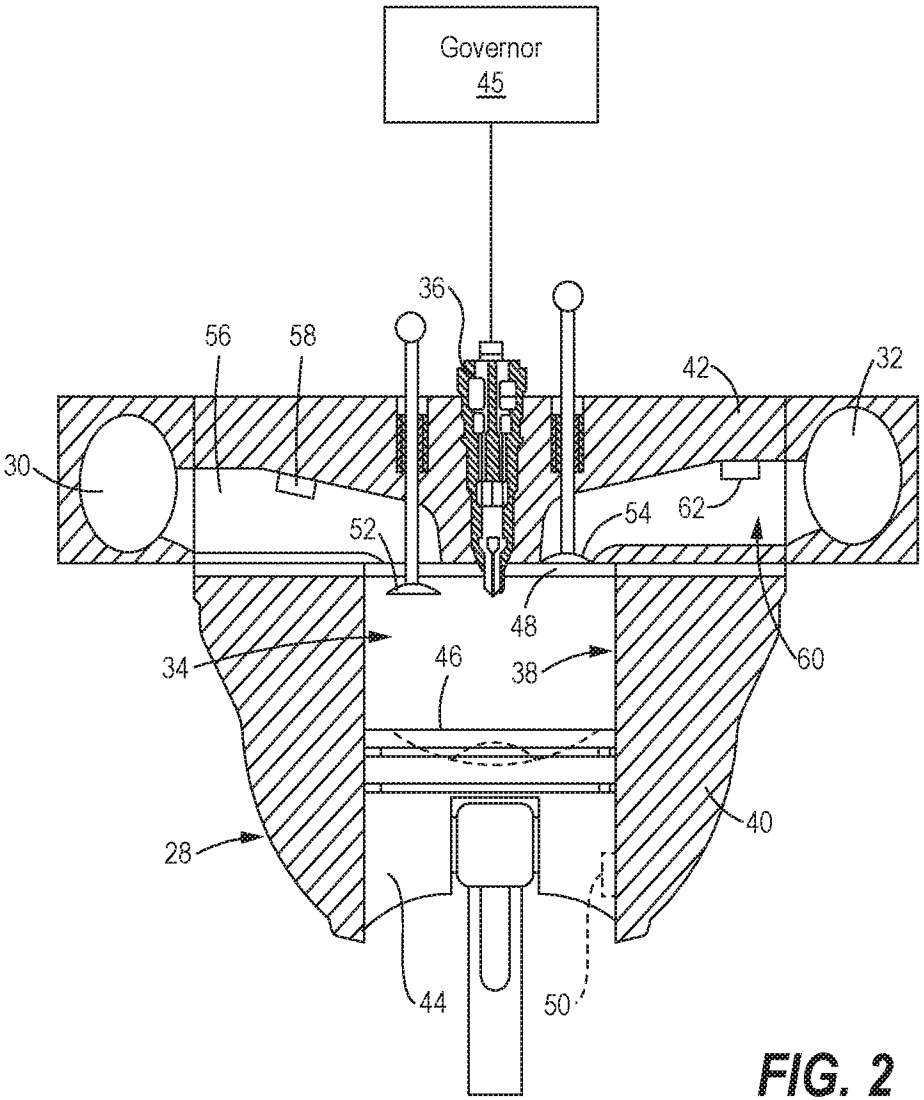
FIG. 2 is a partial cross-sectional view of a cylinder of the exemplary power generator of FIG. 1.

Referring now to FIG. 2, with continued reference to FIG. 1, a cross-section of an exemplary cylinder 28 of the plurality of cylinders 27 included in the internal combustion engine 22 is provided. For simplicity, only a single cylinder 28 is illustrated, but it will be understood that each cylinder 28 included in the plurality of cylinders 27 may be similarly configured. The cylinder 28 defines a combustion chamber 34 in which air is delivered by the air intake system 30 and combined with fuel injected into the combustion chamber 34 by a fuel injector 36. The cylinder 28 further includes a cylinder bore 38 formed in an engine block 40 portion of the internal combustion engine 22 and a cylinder head 42 covers or otherwise encloses the cylinder bore 38. A piston 44 is disposed within and slidably engaged with sidewalls of the cylinder bore 38 such that the piston 44 is capable of reciprocating within the cylinder bore 38. Furthermore, the fuel injector 36 may extend through the cylinder head 42 and into at least a portion of the combustion chamber 34 such that fuel is injected within the combustion chamber 34 of the cylinder 28. Additionally, a fuel governor 45 may be operatively coupled to the fuel injector 36 and configured to regulate and control an amount of fuel delivered to the fuel injector 36 and injected into the combustion chamber 34 of the cylinder 28.

In an embodiment, the combustion chamber 34 is defined by the cylinder bore 38, a top surface 46 of the piston 44 and an interior surface 48 of the cylinder head 42. Moreover, a volume of the combustion chamber 34 may be variable such that as the piston 44 reciprocates within the cylinder bore 38, the volume of the combustion chamber 34 increases and/or decreases. Additionally, the cylinder 28 may include a cylinder sensor 50 operatively attached along the cylinder bore 38, or other such location within the cylinder 28. The cylinder sensor 50 may be a pressure sensor, a temperature sensor, a combination thereof or other such sensor. Accordingly, the cylinder sensor 50 may be configured to measure and/or monitor one or more conditions within each cylinder 28 of the internal combustion engine 22 such as but not limited to pressure, temperature, or other such operational condition of the cylinder 28.

Additionally, the cylinder 28 may include one or more valves which fluidly connect and/or disconnect one or more pathways into and out of the cylinder 28. For example, the cylinder 28 may include at least one intake valve 52 and at least one exhaust valve 54. The intake valve 52 may be selectively actuated to open and/or close an air intake pathway 56 formed within the cylinder head 42 such that the cylinder 28 is fluidly coupled with the air intake system 30. As further illustrated in FIG. 2, the intake valve 52 may be actuated into an open position to allow air to flow through the air intake pathway 56 and into the combustion chamber 34. The air intake pathway 56 may further include an intake pathway sensor 58 such as but not limited to, a flow sensor, a temperature sensor, or other such sensor, to measure and/or monitor air as it moves through the air intake pathway 56. Conversely, the exhaust valve 54 is shown in FIG. 2 in a closed position. However, the exhaust valve 54 may be selectively actuated into an open position which will allow exhaust air (i.e., combustion by-products) to flow out of the combustion chamber 34 and into an exhaust pathway 60, formed in the cylinder head 42. The exhaust pathway 60 may be fluidly coupled to the air exhaust system 32 where the exhaust air may be directed away from the internal combustion engine 22 and released into the external environment surrounding the power generator 20. The exhaust pathway 60 may also include an exhaust pathway sensor 62 (e.g., a temperature sensor, a flow sensor, an oxygen sensor, a NOx sensor and the like) to measure and/or monitor the exhaust air flowing through the exhaust pathway 60. The exhaust pathway 60 may be further coupled to exhaust treatment components (not shown) which treat the exhaust to reduce and/or remove certain contaminants within the exhaust air as it flows through the exhaust pathway 60.

Figure 3:
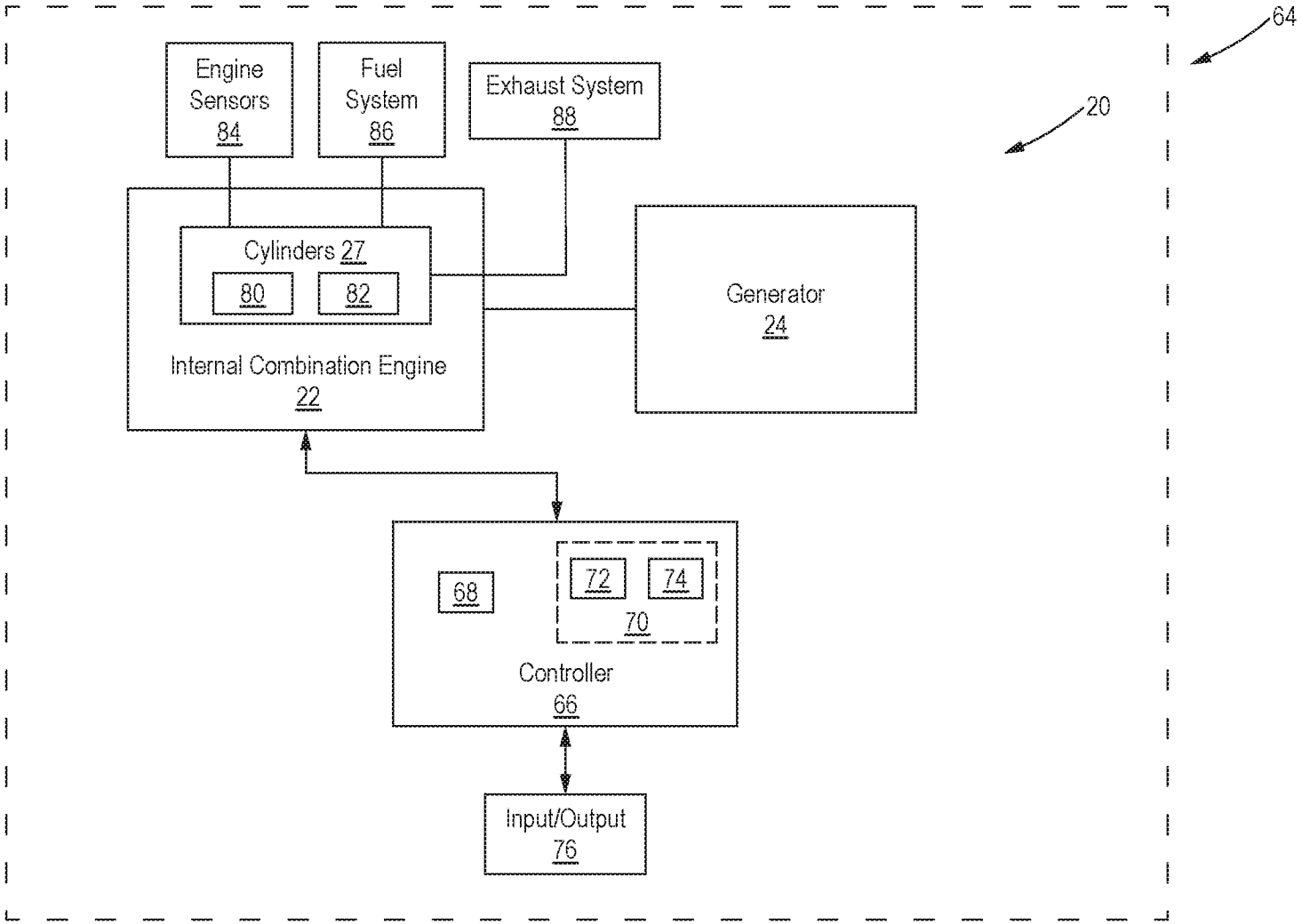
FIG. 3 is a schematic view of an exemplary control system in accordance with the teachings of the present disclosure.

Turning to FIG. 3, an exemplary schematic illustration of a power generator control system 64 configured to control and operate the internal combustion engine 22, the generator 24 and other such components of the power generator 20 is provided. As such, the power generator control system 64 may include an electronic controller 66 that is communicably coupled with the internal combustion engine 22 and other components of the power generator 20. The electronic controller 66 may be programmed to transfer data and operational instructions (e.g., send and/or receive data signals) with the internal combustion engine 22, the generator 24 and other components and systems of the power generator 20. Moreover, the electronic controller 66 may include algorithms and/or software stored therein to analyze and/or process data received by or otherwise input into the electronic controller 66. Additionally, the algorithms and/or software may be programmed to generate control signals and/or other instructions based on analysis and/or processing of data and the electronic controller 66 may output or otherwise transmit the control signals to the power generator 20.

Accordingly, the electronic controller 66 may include a microprocessor 68 which executes the algorithms, firmware, software or other such logic operations stored within a memory module 70 of the electronic controller 66. The memory module 70 may include read-only memory (ROM) 72 which provides storage space for at least some of the algorithms, firmware, software, logic operations and other executable data files used by the electronic controller 66. Additionally, the memory module 70 may include solid-state memory 74 (e.g., random-access memory (RAM), flash memory and the like). The solid-state memory 74 may be configured to provide additional storage of algorithms, software, firmware, logic operations, and other executable data files used by the electronic controller 66. Moreover, the solid-state memory 74 may provide an active storage device which the electronic controller 66 may access to perform calculations, save data, and/or perform other such operations on data stored in the memory module 70 or other location of the electronic controller 66. While FIG. 3 illustrates the electronic controller 66 including the microprocessor 68 and memory module 70, it will be appreciated that the electronic controller 66 may additionally and/or alternatively include other components such as but not limited to, a microcontroller, an application specific integrated circuit (ASIC), a remotely accessed memory and the like, to execute and carryout operations of the electronic controller 66.

As further illustrated in FIG. 3, the electronic controller 66 may be communicably coupled to or otherwise integrated with an input and/or output device 76 such that a user or other interested individual of the power generator 20 can access and/or interact with the electronic controller 66. For example, the input and/or output device 76 may be used or otherwise configured to input or execute instructions, data and/or commands through a keyboard, a mouse, a dial, a button, a joystick, a touch screen, a microphone, other known input devices or any combination thereof. Additionally, data and other information stored in the electronic controller 66 may be output by the input and/or output device 76 to a display device such as but not limited to, a monitor, a speaker, a touch screen, other such video/audio device or any combination thereof capable of displaying or otherwise communicating information output by the electronic controller 66. In some embodiments, the input and/or output device 76 may be communicably coupled to the electronic controller 66 through a wired connection. Alternatively, the input and/or output device 76 may be coupled to the electronic controller 66 through a wireless communication network such as a computer data network, a Wi-Fi data network, a Bluetooth network, a near-field communication network, a radio-frequency communication network, a cellular data network, a satellite data network and the like. In an embodiment, the input and/or output device 76 may be integrated with the electronic controller 66 and configured as a mobile electronic device such as but not limited to, a tablet computer, a smart phone, a cellular telephone, a laptop computer or other such mobile electronic device. As a result, the input and/or output device 76 and the electronic controller 66 may be in wireless communication with the power generator 20 such that a user or other interested personnel of the power generator 20 may control and operate the power generator 20 from a remote location.

As further illustrated in FIG. 3, an exemplary embodiment, the electronic controller 66 may be communicably coupled to the internal combustion engine 22 and configured to control and monitor the internal combustion engine 22 of the power generator 20. The internal combustion engine 22 includes the plurality of cylinders 27 which may be further defined as having a first pattern 80 of cylinders 27 and a second pattern 82 of cylinders 27. In one non-limiting example, the plurality of cylinders 27 represents a total of six cylinders; however it will be appreciated the internal combustion engine 22 may include fewer than or greater than six cylinders (e.g., 4 cylinders, 8 cylinders, 12 cylinders, etc.). Accordingly, in the above described non-limiting example, the six cylinder internal combustion engine 22 is configured such that the first pattern 80 of cylinders 27 may include cylinders 1, 2 and 3 and the second pattern 82 of cylinders 27 may include cylinders 4, 5 and 6; however, other groupings of cylinders are possible (i.e., even/odd, and/or unequal numbers of cylinders in each pattern).

The internal combustion engine 22 may be operatively coupled to a plurality of engine sensors 84, a fuel system 86, an exhaust system 88 and other such systems and components. The engine sensors 84 may include sensors such as but not limited to, the cylinder sensor 50, the intake pathway sensor 58 and the exhaust pathway sensor 62. Accordingly, the engine sensors 84 may be configured to measure flow, temperature, pressure and other such operational conditions of the cylinders 27. Additionally, the engine sensors 84 may be further configured to measure and monitor the air flow moving through the air intake pathway 56 and exhaust pathway 60, as discussed above and illustrated in FIG. 2. In an embodiment, the engine sensors 84 further include an engine speed sensor (not shown), a fuel flow sensor (not shown), an engine coolant temperature sensor (not shown) and other such sensors that monitor one or more operating conditions of the internal combustion engine 22.

The electronic controller 66 may be configured to receive one or more feedback signals and other data that is collected from the engine sensors 84. Accordingly, the electronic controller 66 may store the received signals in the memory module 70, and algorithms, firmware, software or other such logic operations, also stored within the memory module 70, may be programmed to monitor and/or analyze the feedback signals for one or more predefined engine operating conditions. For example, the electronic controller 66 may monitor for one of a normal/default condition, a cold-start condition, a low load condition, or other such operational condition of the internal combustion engine 22.

In an embodiment, the normal/default condition may be identified or otherwise detected by the power generator control system 64 when feedback signals received from the engine sensors 84, fuel system 86 and/or exhaust system 88 indicate that the internal combustion engine 22 is operating under normal and/or optimal operating conditions (e.g., speed, load, temperature). Conversely, the cold-start condition may be identified by the power generator control system 64 when feedback signals received from the engine sensors 84, fuel system and/or exhaust system 88 indicate the internal combustion engine 22 has just been started and may not be operating under normal and/or optimal operating conditions. Additionally or alternatively, the low load condition may be identified when feedback signals received from the engine sensors 84, fuel system 86 and/or exhaust system 88 indicate the internal combustion engine 22 may be beyond the warm up cycle following a cold-start but the engine is operating at less than full or optimal load conditions (i.e., low load or idle condition).

Furthermore, the fuel system 86 is operatively coupled to the internal combustion engine 22 and may include a plurality of fuel injectors similar to the fuel injector 36 illustrated in FIG. 2. For example, each cylinder 28 (FIG. 2) of the plurality of cylinders 27 may include at least one fuel injector 36 (FIG. 2) that injects fuel into the combustion chamber 34 or other portion of the cylinder 28 (FIG. 2). The fuel system 86 may further include the fuel governor 45 (FIG. 2) that is fluidly coupled to each fuel injector 36 included in the internal combustion engine 22. Moreover, the fuel governor 45 may be controlled by the power generator control system 64 to deliver an amount of fuel determined by the electronic controller 66 to each fuel injector 36. The amount of fuel delivered may be based on one or more detected operating conditions of the internal combustion engine 22. The fuel system 86 may also include a fuel reservoir, a fuel pump, fuel sensors (which may be additional to and/or shared with the engine sensors 84 described above) and other such components. The electronic controller 66 may be further configured to receive one or more feedback signals and other collected data from the fuel system 86. Accordingly, the electronic controller 66 may store the received signals in the memory module 70 similar to the signals received from the engine sensors 84.

Moreover, the exhaust system 88 may also be operatively coupled to the internal combustion engine 22 and configured to monitor and/or treat the exhaust gas, and other combustion by-products, before they are discharged from the internal combustion engine 22 into the surrounding environment. The exhaust system 88 may include sensors such as the exhaust pathway sensor 62 (FIG. 2). The exhaust pathway sensor 62 may be further included with the plurality of engine sensors 84 that monitor the internal combustion engine 22 and send feedback signals to the electronic controller 66. The exhaust system 88 may include additional sensors that monitor and/or measure one or more exhaust air conditions (e.g., temperature, flow, composition and the like). The exhaust system 88 may further include post-combustion treatment devices (not shown) that filter and remove combustion by-products such as but not limited to nitrogen oxide, carbon dioxide, oxygen, particulates, and other by-products. The electronic controller 66 may be further configured to receive one or more feedback signals and other collected data from the exhaust system 88. Accordingly, the electronic controller 66 may store the received signals in the memory module 70 similar to the signals received from the engine sensors 84 and the fuel system 86.

As discussed above, an embodiment of the power generator control system 64 may include algorithms, firmware, software or other such logic operations stored within a memory module 70 of the electronic controller 66 which are programmed to detect operational conditions such as the default condition, the cold-start condition, the low load condition and other such conditions of the internal combustion engine 22. For example, during the cold-start condition and/or the low load condition, analysis of feedback signals received from the engine sensors 84 (e.g., intake air temperature, exhaust temperature, engine speed), the fuel system 86 (e.g., fuel delivery), and/or the exhaust system 88 (e.g., exhaust composition) may indicate that the internal combustion engine 22 is operating in an inefficient and/or suboptimal manner.

Accordingly, an embodiment of the power generator control system 64 may execute algorithms, firmware, software or other such logic operations that are able to send control signals from the electronic controller 66 to the internal combustion engine 22 to help improve operational performance of the internal combustion engine 22 during periods of inefficient and/or suboptimal operation. During such conditions, one or more cylinders of the plurality of cylinders 27 may experience poor and/or incomplete combustion of fuel due to low engine temperature, low/no load or other such condition. Thus, in attempt to improve performance of the internal combustion engine 22 the power generator control system 64 may be programmed to execute a cylinder cutout strategy 90 (see FIGS. 4A-4C) which is programmed to selectively deactivate and/or otherwise temporarily disable one or more cylinder of the plurality of cylinders 27. In one non-limiting example, the cylinder cutout strategy 90 (see FIGS. 4A-4C) selects either the first pattern of cylinders 80 or the second pattern of cylinders 82 (i.e., cylinders 1, 2, 3 or cylinders 4, 5, 6 for a six cylinder engine) for testing. Once a cylinder pattern is selected, the cylinder cutout strategy 90 may then conduct the testing on the selected pattern of the first pattern 80 or second pattern 82 of cylinders 27 to determine which cylinders of the plurality of cylinders 27 may be deactivated in attempts to improve engine performance.

Figure 4A:
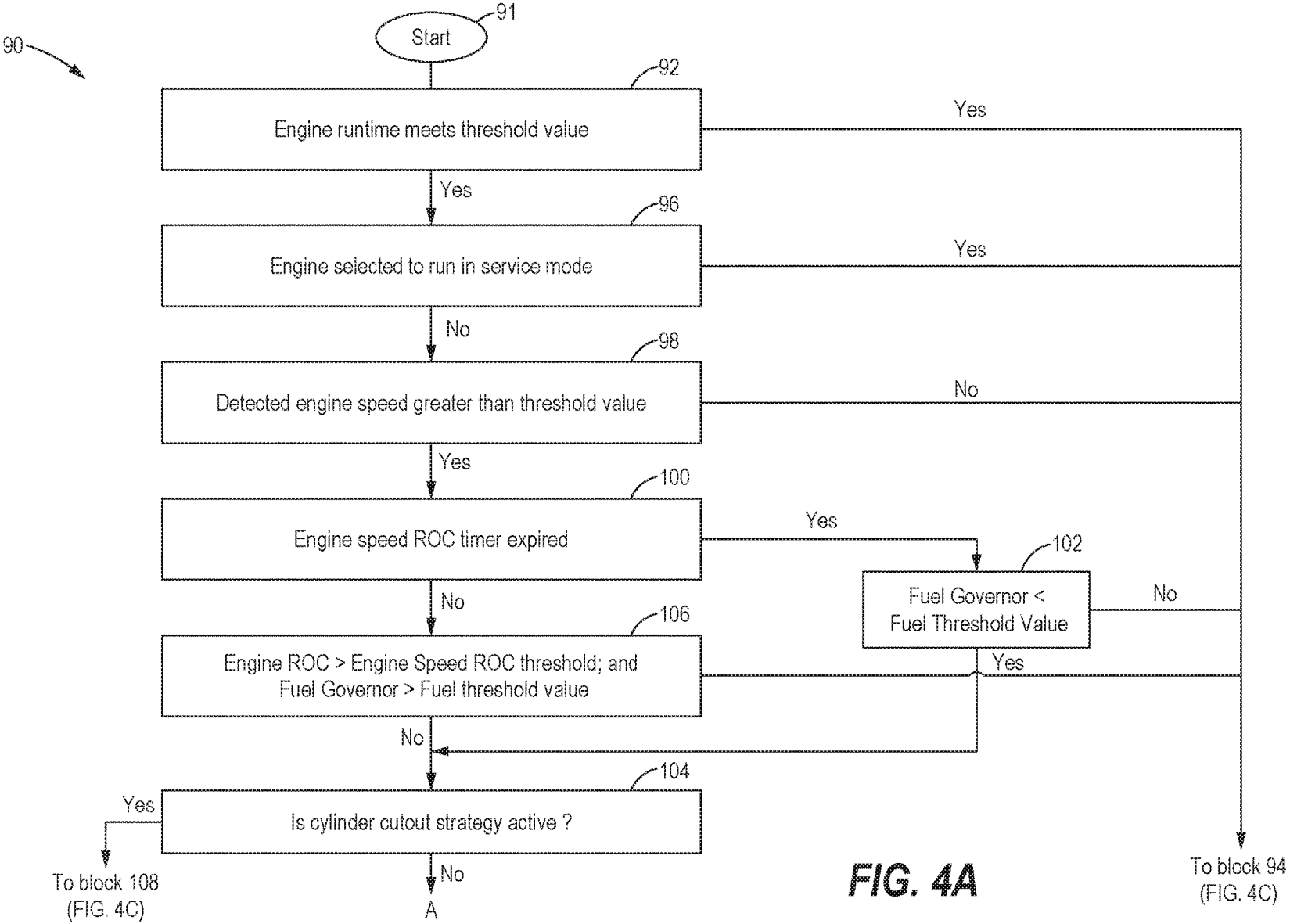
FIG. 4A is a flow diagram of an exemplary control strategy executed by the control system of FIG. 3, in accordance with the teachings of the present disclosure.
Figure 4B:
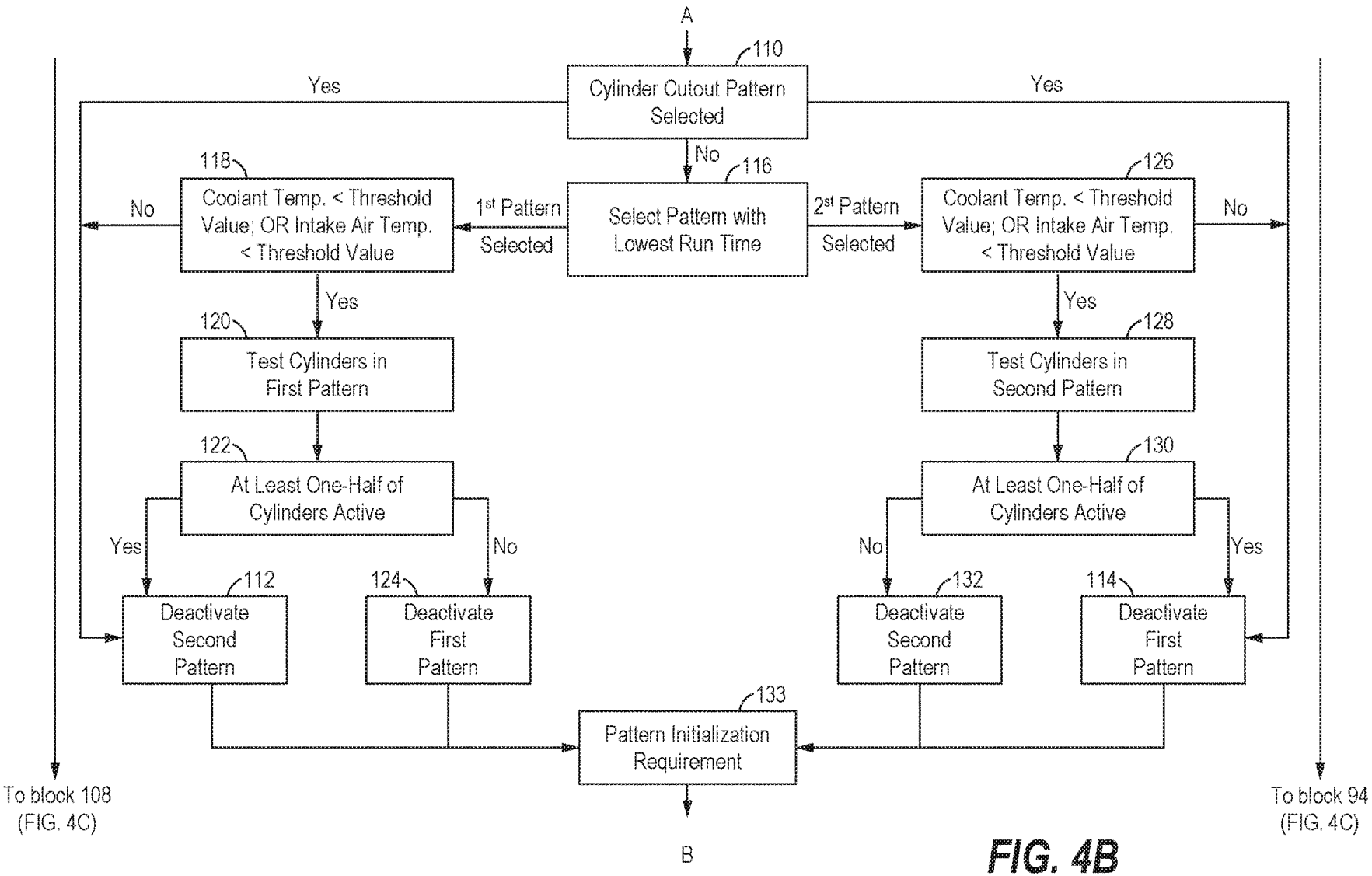
FIG. 4B is a continuation of the flow diagram of FIG. 4A.
Figure 4C:
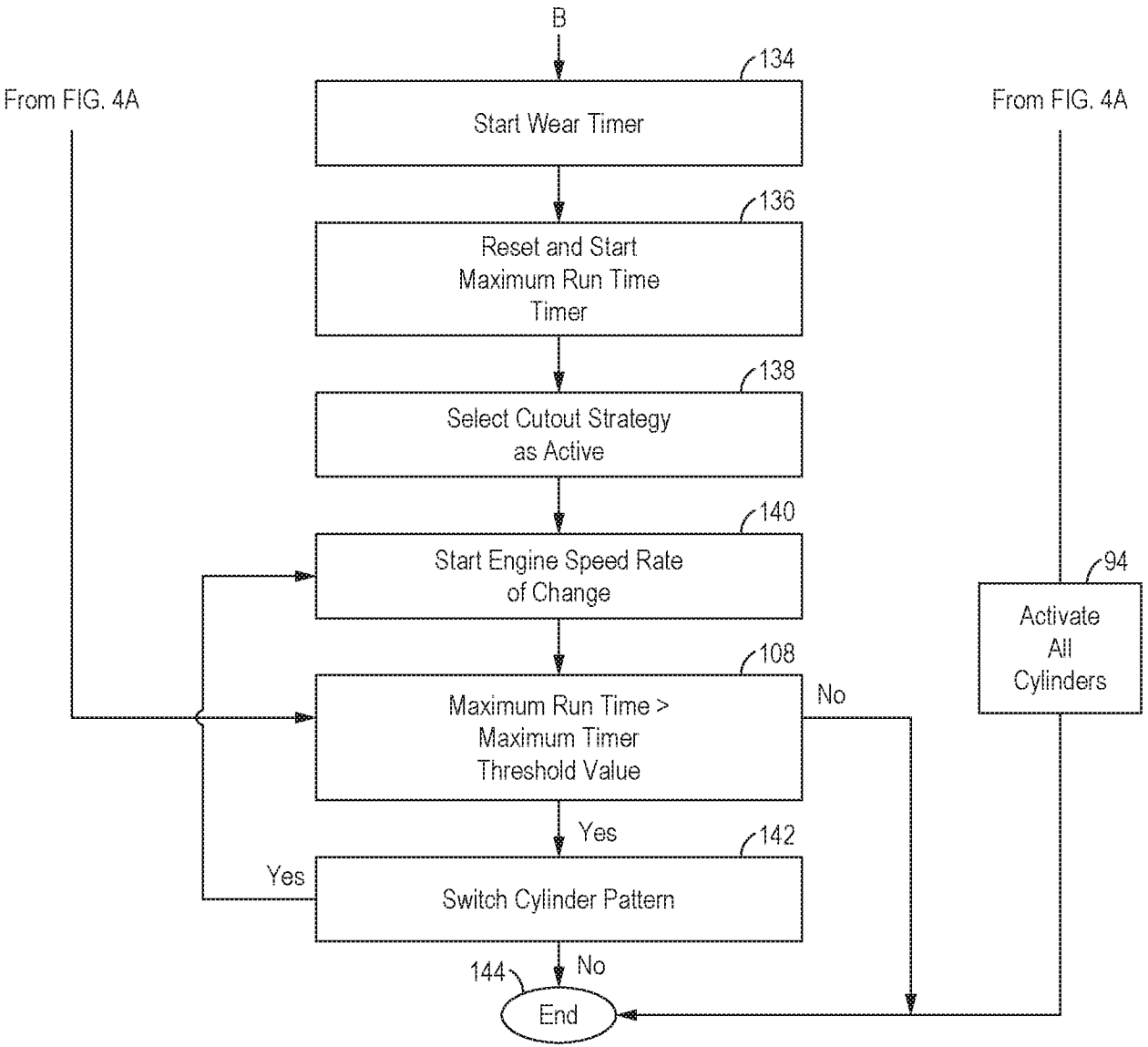
FIG. 4C is a continuation of the flow diagrams of FIGS. 4A-4B.

Referring now to FIGS. 4A-4C, with continued reference to FIG. 3, a flow chart of one non-limiting example of the cylinder cutout strategy 90 is provided. As discussed above, the cylinder cutout strategy 90 may include algorithms, firmware, software or other such logic operations that are programmed to evaluate one or more conditions of the internal combustion engine 22. Furthermore, the cylinder cutout strategy 90 may be stored or otherwise located in the memory module 70 of the electronic controller 66. As such, during the execution or start 91 of the cylinder cutout strategy 90, the power generator control system 64 may analyze one or more feedback signals and other such data received from the engine sensors 84, the fuel system 86, the exhaust system 88 and other such systems and components of the internal combustion engine 22. In a first block 92, the cylinder cutout strategy 90 begins a verification of engine conditions which are conducive to executing the cylinder cutout strategy 90. The electronic controller 66 receives an engine run time data signal and an engine speed data signal from at least one of the engine sensors 84. The engine run time data signal may provide a cumulative run time which monitors how long the internal combustion engine 22 has been running and the engine speed data signal may indicate a rotational speed of the internal combustion engine 22. Furthermore, the electronic controller 66 may compare the engine run time data signal with a predetermined engine runtime threshold value that was input or otherwise programmed into the cylinder cutout strategy 90. Additionally, the electronic controller 66 may compare the engine speed data signal with a predetermined engine speed threshold that was input or otherwise programmed into the cylinder cutout strategy 90. If the value of the engine run time data signal is not greater than the engine runtime threshold value and the value of the engine speed data signal is not greater than the engine speed threshold value (i.e., speed greater than low idle speed of the internal combustion engine 22) then the internal combustion engine 22 may be attempting to start and the cylinder cutout strategy 90 proceeds to block 94 (see FIG. 4C) where the power generator control system 64 disables or otherwise terminates the cylinder cutout strategy 90 and all cylinders of the plurality of cylinders 27 are instructed to fire, or remain firing.

Alternatively, if the cylinder cutout strategy 90 determines that the value of the engine run time data signal is greater than the predetermined engine runtime threshold value and the value of the engine speed data signal is greater than the engine speed threshold value or the low idle setting (e.g., 600 RPM) of the internal combustion engine 22, then the cylinder cutout strategy 90 proceeds to a next block 96 to determine whether the power generator 20 is operating under a maintenance mode such as but not limited to, a service test condition or a manual cylinder cutout condition. In an embodiment, the engine sensors 84, the fuel system 86 and/or the exhaust system 88 may send one or more feedback signals to the electronic controller 66 to indicate the power generator 20 is being operated in a service or maintenance mode. Additionally or alternatively, a service technician or other user of the power generator 20 may input one or more maintenance parameters into the electronic controller 66 to indicate the power generator 20 is operating in a maintenance mode. As such, if a service or maintenance mode is detected then cylinder cutout strategy 90 may be directed to block 94 where the power generator control system 64 disables or otherwise terminates the cylinder cutout strategy 90 and all cylinders of the plurality of cylinders 27 are fired, remain firing or operate according to the service and/or maintenance mode.

If the cylinder cutout strategy 90 determines the power generator 20 is not in a service or maintenance mode, the cylinder cutout strategy 90 may proceed to a next block 98 to compare a predetermined acceptable error rate for the detected engine speed with a predetermined cylinder cutout strategy engine speed threshold value plus a predetermined hysteresis value for the detected engine speed. If the predetermined acceptable error rate for the detected engine speed is less than the predetermined cylinder cutout strategy engine speed threshold value plus the predetermined hysteresis value, then the cylinder cutout strategy 90 may be directed to block 94 where the power generator control system 64 disables or otherwise terminates the cylinder cutout strategy 90 and all cylinders of the plurality of cylinders 27 are fired or remain firing.

If the predetermined acceptable error rate for the detected engine speed is greater than the predetermined cylinder cutout strategy engine speed threshold value plus the predetermined hysteresis value, then the cylinder cutout strategy 90 may proceed to a next block 100 where the cylinder cutout strategy 90 analyzes one or more feedback signals received from an engine speed rate of change (ROC) timer to determine whether the timer has exceeded a predetermined time (i.e., has the timer expired). The engine speed ROC timer may be included in the engine sensors 84, the fuel system 86 and/or the exhaust system 88. If the cylinder cutout strategy 90 determines the engine speed ROC timer has expired, in a next block 102 the cylinder cutout strategy 90 looks at feedback signals received from the engine sensors 84, the fuel system 86 and exhaust system 88 to compare an output value or setting of the fuel governor 45 with a cylinder cutout strategy fuel threshold value plus a threshold value for a cylinder cutout strategy fuel stability time. If the cylinder cutout strategy 90 determines the fuel governor 45 output value or setting is less than the cylinder cutout strategy fuel threshold value plus a threshold value for a cylinder cutout strategy fuel stability time, then the cylinder cutout strategy 90 may proceed to a next block 104, otherwise the cylinder cutout strategy 90 may be directed to block 94 where the power generator control system 64 disables or otherwise terminates the cylinder cutout strategy 90 and all cylinders of the plurality of cylinders 27 are fired or remain firing.

Referring back to block 100, if the engine speed ROC timer is determined to not have expired, the cylinder cutout strategy 90 may proceed to block 106. In block 106, the cylinder cutout strategy 90 compares the engine speed signal ROC value with the predetermined engine speed ROC threshold value plus hysteresis along with comparing the fuel governor 45 output or setting against the predetermined cylinder cutout strategy threshold. If the engine speed ROC is less than the engine speed ROC threshold plus hysteresis and the setting of the fuel governor 45 is less than the cylinder cutout strategy fuel threshold then the cylinder cutout strategy 90 may proceed to block 104. Otherwise, the cylinder cutout strategy 90 may proceed to block 94 where the power generator control system 64 disables or otherwise terminates the cylinder cutout strategy 90 and all cylinders of the plurality of cylinders 27 are fired or remain firing.

In block 104, the cylinder cutout strategy 90 analyzes feedback signals received from the engine sensors 84, the fuel system 86, the exhaust system 88 and other components and/or systems of the power generator 20 to determine the cylinder cutout strategy 90 is not already active. If all the parameters are met, then the power generator control system 64 enables the cylinder cutout strategy 90 to proceed with a pattern selection of either the first pattern 80 of cylinders 27 or the second pattern 82 of cylinders 27. On the other hand, if it is determined that the cylinder cutout strategy 90 is already active, then the cylinder cutout strategy 90 will proceed to block 108 (FIG. 4C) where a comparison between the detected cylinder cutout strategy max timer is compared with a predetermined threshold value for the cylinder cutout strategy max timer, as discussed in more detail below.

Once the cylinder cutout strategy 90 has been enabled by the power generator control system 64, in a next block 110, the cylinder cutout strategy 90 analyzes feedback signals and data received from the engine sensors 84, fuel system 86, exhaust system 88 and other components of the power generator 20 to determine whether one of the first pattern 80 of cylinders 27 or the second pattern 82 of cylinders 27 has already been selected or whether a cylinder test is currently being performed by the cylinder cutout strategy 90. For example, if in block 110 it is determined that the first pattern 80 of cylinders 27 has been selected or otherwise activated, then in block 112 the cylinder cutout strategy 90 will execute cutout of the second pattern 82 of cylinders 27. Conversely, if in block 110 it is determined that the second pattern 82 of cylinders 27 has been selected or otherwise activated, then in block 114, the cylinder cutout strategy 90 will execute cutout of the first pattern 80 of cylinders 27.

Alternatively, if neither the first pattern 80 of cylinders 27 nor the second pattern 82 of cylinders 27 is found to have been selected or otherwise activated by the power generator control system 64, then the cylinder cutout strategy 90 may proceed to a next block 116. In block 116 the electronic controller 66 analyzes feedback signals received from the engine sensors 84, fuel system 86, exhaust system 88 and other components of the power generator 20 to select one of the first pattern 80 or the second pattern 82 of cylinders 27 for further evaluation. Additionally, at least one of the feedback signals received from the engine sensors 84 is a cumulative run time maintained for each of the first pattern 80 and the second pattern of cylinders 82. The electronic controller 66 analyzes the cumulative run time and selects the cylinder pattern (i.e., first pattern 80 or second pattern 82) that has the lower cumulative run time. As a result, selecting the cylinder pattern with the lower run time may help the power generator control system 64 equalize the wear and cumulative run time between the first pattern 80 and the second pattern of cylinders 82 because the same cylinder pattern is not always chosen and tested by the cylinder cutout strategy 90.

If the first pattern 80 of cylinders 27 is determined to have the lowest run time, then in a next block 118, the electronic controller 66 analyzes feedback signals received from the engine sensors 84, the fuel system 86, the exhaust system 88 and other components of the power generator 20 to compare an engine coolant temperature or an intake air temperature with a predetermined threshold coolant and intake air temperature, respectively. If the coolant temperature and/or the intake air temperature are less than the predetermined threshold value, then the cylinder cutout strategy 90 may determine the internal combustion engine 22 is operating in a cold-start condition and cylinder cutout should be activated. As a result, the cylinder cutout strategy 90 may proceed to a next block 120, to perform a cylinder test on the first pattern 80 of cylinders 27.

Alternatively, if the coolant temperature and/or intake air temperature is greater than the predetermined threshold value, the cylinder cutout strategy 90 may determine the internal combustion engine 22 is operating in a low load condition or other such non cold-start-up condition. The cylinder cutout strategy 90 may then proceed to block 112 and deactivate or cutout the second pattern 82 of cylinders 27. In this case, the second pattern 82 of cylinders 27 is deactivated to even out wear between the cylinder patterns because in block 116 it was determined that the first pattern 80 of cylinders 27 had a lower cumulative run time compared to the second pattern 82 of cylinders 27.

Referring back to block 120, if the cold-start condition is detected by the electronic controller 66, then the cylinder cutout strategy 90 will execute the cylinder test on the first pattern 80 of cylinders 27 to determine if a specific cylinder (e.g., 1, 2 and 3) is producing power or if the specific cylinder is inactive and/or operating in an inefficient manner. The cylinder test executed by the cylinder cutout strategy 90 will turn off one cylinder at a time from the first pattern 80 of cylinders 27 and the electronic controller 66 will monitor feedback signals and data received from the engine sensors 84, fuel system 86, exhaust system 88 and other components of the power generator 20. In one embodiment, the electronic controller 66 will analyze or monitor the amount of fuel delivered by the fuel governor 45 to each cylinder of the first pattern 80 of cylinders 27. For example, if cylinder 1 from the first pattern 80 of cylinders 27 is producing power before it is shut off, the electronic controller 66 may detect an increase in fuel from the fuel governor 45 to the remaining cylinders (i.e., cylinder 2 and/or cylinder 3) as it tries to maintain the engine speed and load with one less power producing cylinder being active.

Conversely, if cylinder 1 from the first pattern 80 of cylinders 27 is not producing power before it is shut off, the electronic controller 66 may not detect an increase in fuel from the fuel governor 45 to the remaining cylinders. The cylinder cutout strategy 90 may then leave cylinder 1 deactivated while the test is completed in order to improve efficiency of the internal combustion engine 22 and reduce the amount of unburned hydrocarbon or other such incompletely combusted fuel by-product. The cylinder test will be repeated on the remaining cylinders in the first pattern 80 of cylinders 27.

Once the cylinder test is complete, in a next block 122, the cylinder cutout strategy 90 will analyze the test results to determine which cylinder pattern should be cutout or deactivated. In an embodiment, the cylinder cutout strategy 90 determines whether at least one-half of the cylinders in the first pattern 80 of cylinders 27 were active. For example, the first pattern 80 of cylinders 27 may include three cylinders (i.e., cylinders 1, 2 and 3). If at least two cylinders were found to be active then the first pattern 80 of cylinders 27 will remain active and the cylinder cutout strategy will proceed to block 112 and cutout or deactivate the second pattern 82 of cylinders 27. Alternatively, if one or fewer cylinders in the first pattern 80 of cylinders 27 were found to be active during the test, then the cylinder cutout strategy 90 will proceed to block 124 and cutout or deactivate the first pattern 80 of cylinders 27 and activate the second pattern 82 of cylinders 27.

Referring back to block 116, if the second pattern 82 of cylinders 27 is determined to have the lowest run time, then in a next block 126, the electronic controller 66 analyzes feedback signals received from the engine sensors 84, the fuel system 86, the exhaust system 88 and other components of the power generator 20 to compare an engine coolant temperature or an intake air temperature with a predetermined threshold coolant and intake air temperature, respectively. If the coolant temperature and/or the intake air temperature are less than the predetermined threshold value, then the cylinder cutout strategy 90 may determine the internal combustion engine 22 is operating in a cold-start condition and cylinder cutout should be activated. As a result, the cylinder cutout strategy 90 may proceed to a next block 128, to execute a cylinder test on the second pattern 82 of cylinders 27.

Alternatively, if the coolant temperature and/or intake air temperature is greater than the predetermined threshold value, the cylinder cutout strategy 90 may determine the internal combustion engine 22 is operating in a low load condition or other such non cold-start-up condition and the cylinder cutout strategy 90 may alternatively proceed to block 114 and deactivate or cutout the first pattern 80 of cylinders 27. In this case, the first pattern 80 of cylinders 27 is deactivated to even out wear between the cylinder patterns because of the determination in block 116 that the second pattern 82 of cylinders 27 had a lower cumulative run time compared to the first pattern 80 of cylinders 27.

Referring back to block 128, if the cold-start condition is detected by the electronic controller 66, then the cylinder cutout strategy 90 will execute the cylinder test on the second pattern 82 of cylinders 27 to determine if a specific cylinder (e.g., 4, 5 and 6) is producing power or if the specific cylinder is inactive or operating in an inefficient manner. The cylinder test executed by the cylinder cutout strategy 90 will turn off one cylinder at a time from the second pattern 82 of cylinders 27 and the electronic controller 66 will monitor feedback signals and data received from the engine sensors 84, fuel system 86, exhaust system 88 and other components of the power generator 20.

In one embodiment, the electronic controller 66 will analyze or monitor the amount of fuel delivered by the fuel governor 45 to each cylinder of the second pattern 82 of cylinders 27. For example, if cylinder 4 from the second pattern 82 of cylinders 27 is producing power before it is shut off, the electronic controller 66 may detect an increase in fuel delivered from the fuel governor 45 to the remaining cylinders (i.e., cylinder 5 and/or cylinder 6) as it tries to maintain the engine speed and load with one less power producing cylinder being active.

Conversely, if cylinder 4 from the second pattern 82 of cylinders 27 is not producing power before it is shut off, the electronic controller 66 may not detect an increase in fuel delivered from the fuel governor 45 to the remaining cylinders. The cylinder cutout strategy 90 may then leave cylinder 4 deactivated while the test is completed in order to improve efficiency of the internal combustion engine 22 and reduce the amount of unburned hydrocarbon or other such incompletely combusted fuel by-product. The cylinder test will be repeated on the remaining cylinders in the second pattern 82 of cylinders 27.

Once the cylinder test is complete on the second pattern 82 of cylinders 27, in a next block 130, the cylinder cutout strategy 90 will analyze the test result to determine which cylinder pattern will be cutout or deactivated. In an embodiment, the cylinder cutout strategy 90 determines if at least one half of the cylinders in the second pattern 82 of cylinders 27 were active. For example, the second pattern 82 of cylinders 27 may include three cylinders (i.e., 4, 5 and 6). If at least two cylinders were found to be active then the second pattern 82 of cylinders 27 will remain active and the cylinder cutout strategy 90 will proceed to block 114 and cutout or deactivate the first pattern 80 of cylinders 27. Alternatively, if less than two cylinders were found to be active during the test, the cylinder cutout strategy 90 will then proceed to block 132 and cutout or deactivate the second pattern 82 of cylinders 27 and activate the first pattern 80 of cylinders 27.

The above cylinder test example incorporates the internal combustion engine 22 having six cylinders, the first pattern 80 of cylinders 27 defined as cylinders 1, 2, and 3, and the second pattern 82 of cylinders 27 defined as cylinders 4, 5, 6. However, it will be understood that the internal combustion engine 22 may have fewer or greater numbers of cylinders (e.g., 2, 4, 8, 10 etc.) and the first pattern 80 of cylinders 27 and the second pattern 82 of cylinders 27 will be defined to include half of the total number of cylinders of the internal combustion engine 22.

Once the cylinder cutout strategy 90 selects either the first pattern 80 or the second pattern 82 of cylinders 27, in a next block 133, the cylinder cutout strategy 90 instructs the electronic controller 66 to transmit a pattern initialization instruction where one cylinder at a time is shut down from the pattern selected to be deactivated to allow for the electronic controller 66 to detect a speed droop due to switching between the cylinder patterns. As used herein, speed droop is defined as a condition that may occur when potential power producing cylinders 28 and fuel injectors 36 are disabled and the internal combustion engine 22 attempts to maintain the engine speed by increasing the fueling on the active cylinders 28 and fuel injectors 36. The increase in fueling may be detected by the electronic controller 66 which may then disable or deactivate the cylinder cutout strategy 90.

In a next block 134, the electronic controller 66 may transmit a signal to a timer to start the wear timer associated with the selected first pattern 80 or second pattern 82 of cylinders 27. The wear timer may be include in the engine sensors 84, fuel system 86 and/or exhaust system 88. The wear timer keeps track of how long a specific pattern (i.e., first pattern 80 or second pattern 82) of cylinders has been deactivated. Alternatively, the wear timer may be configured to keep track of how long a specific pattern of cylinders has been activated. Additionally, in a next block 136 the electronic controller 66 may instruct the maximum run time timer to reset and begin monitoring how long the chosen pattern (i.e., first pattern 80 or second pattern 82) has been running. In some embodiments, when a predetermined maximum run time threshold is reached the electronic controller 66 will instruct the internal combustion engine 22 to switch over to the other cylinder pattern (i.e., deactivated first pattern 80 or second pattern 82).

In a next block 138, the cylinder cutout strategy 90 may select or otherwise mark that the cylinder cutout strategy 90 is actively enabled. As such, the power generator control system 64 will be able to determine the internal combustion engine is being operated under the cylinder cutout strategy 90 as discussed above with respect to block 104. In a next block 140, an engine speed rate of change (ROC) monitor is started by the cylinder cutout strategy 90. In an embodiment, when the cylinder cutout strategy 90 is activated the engine speed ROC monitor helps account for speed droop which may occur when one of the first pattern 80 or second pattern 82 of cylinders 27 is deactivated. As defined above, speed droop as used herein is a condition that may occur when potential power producing cylinders 28 and fuel injectors 36 are disabled and the internal combustion engine 22 attempts to maintain the engine speed by increasing the fueling on the active cylinders 28 and fuel injectors 36. The increase in fueling may be detected by the electronic controller 66 which may then disable or deactivate the cylinder cutout strategy 90. Thus, to account for the speed droop fueling increase when one cylinder pattern is deactivated (i.e., first pattern 80 or second pattern 82), the engine speed ROC is calculated by the electronic controller 66 and compared to a predetermined threshold value. Accordingly, the cylinder cutout strategy 90 may use the engine speed ROC to maintain activation of the cylinder cutout strategy 90 when the calculated engine speed ROC is below the predetermined threshold value (e.g., in cold-start and low load conditions) and deactivate the cylinder cutout strategy 90 when the calculated engine speed ROC is above the predetermined threshold value (e.g., engine load increase).

In block 108, the cylinder cutout strategy 90 may monitor the maximum run time timer and compare it with the maximum run time threshold value. If the maximum run time is greater than the maximum run time threshold value, the cylinder cutout strategy 90 may proceed to a next block 142, where the cylinder cutout strategy 90 switches which cylinder pattern is activated. For example, if the first pattern 80 of cylinders 27 is active and exceeds the maximum runtime threshold, the first pattern 80 will be deactivated and the second pattern 82 will be activated. Furthermore, upon activation of the other cylinder pattern, the cylinder cutout strategy 90 may return to block 140 and monitor the engine speed ROC. Conversely, if in block 108 the maximum run time is not greater than the maximum run time threshold, the power generator control system 64 may determine it is time to deactivate and/or end the cylinder cutout strategy 90. As such, in a next block 144, the cylinder cutout strategy 90 may be terminated and the electronic controller 66 may instruct or otherwise control all cylinders from the plurality of cylinders 27 to fire or enter into an alternative operational mode.

INDUSTRIAL APPLICABILITY

In general, the present disclosure finds utility in various machines and equipment that include a diesel internal combustion engine, such as stand-by generators, on-highway trucks or vehicles, off-highway machines, earth-moving equipment, aerospace applications, and the like. More particularly, the present disclosure provides a strategy for controlling and operating the diesel internal combustion engine during cold-start conditions during which the engine may exhibit increased vibrations, noise, white smoke or other unburned hydrocarbon production due to poor and/or incomplete combustion. Moreover, the present disclosure provides operation control schemes which selectively adjust the control of the cylinders of the internal combustion engine based on detected and monitored engine operating conditions.

Moreover, tightening emission standards have made it increasingly more important to minimize the amount of pollutants other combustion by-products expelled into the atmosphere by internal combustion engines. Accordingly, more efficient control and operation of diesel engines is needed during cold start-up conditions and low load operational conditions to comply with these standards. In an embodiment of the present disclosure, a cylinder cutout strategy 90 may be executed by the power generator control system 64 to quickly test and electronically disable or otherwise deactivate a ratio of the total number of cylinders of the internal combustion engine 22. As a result, the cylinder cutout strategy 90 may help improve the combustion in the remaining active cylinders while also keeping a consistent engine load and speed during a cold start-up condition and/or low engine load operational condition.

Figure 5:
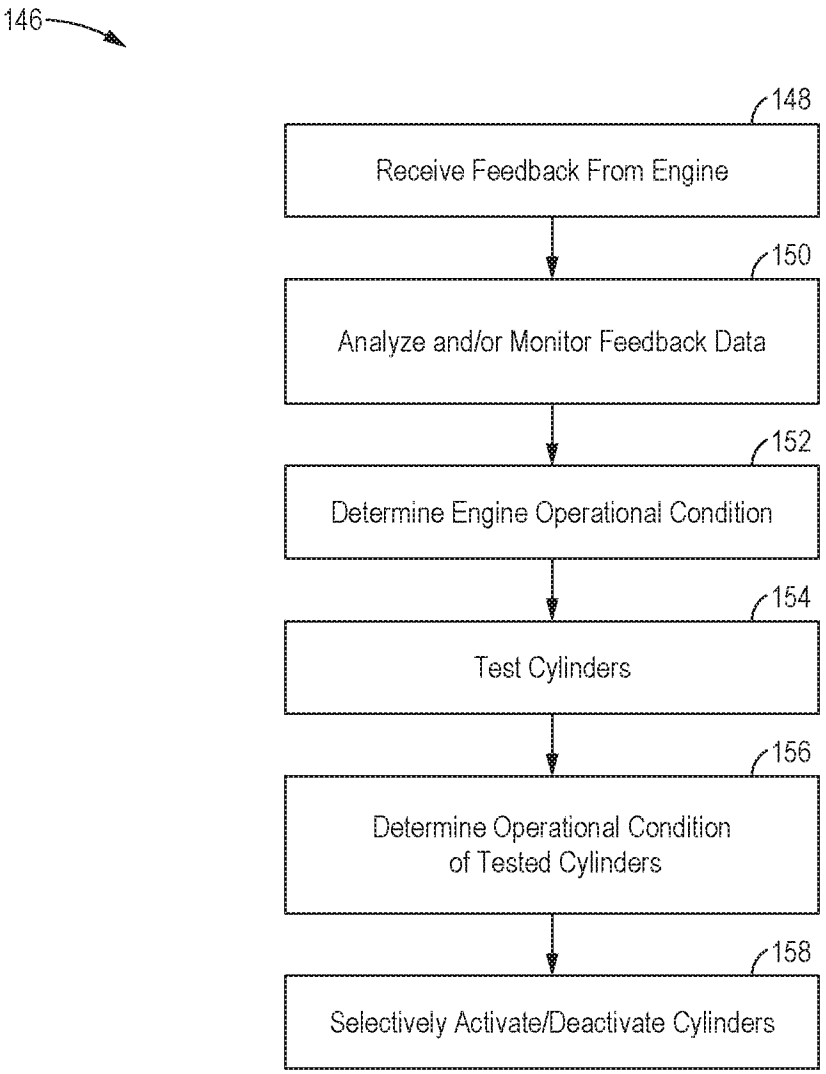
FIG. 5 is a flow diagram of one exemplary method of controlling the power generator of FIG. 1, in accordance with the teachings of the present disclosure.

Referring to FIG. 5, with continued reference to FIGS. 1-4C, one exemplary method or strategy 146 of controlling or operating the power generator 20 is provided. In particular, the method 146 may be include one or more algorithms, instructions, logic operations, or the like, such as the cylinder cutout strategy 90 that is executed by the electronic controller 66. As shown in block 148, the electronic controller 66 may receive feedback signals from a plurality of engine sensors 84, the fuel system 86, the exhaust system 88 and other systems and components of the internal combustion engine 22. Accordingly, in a next block 150 the electronic controller 66 may analyze and continue to monitor the feedback signals received from the internal combustion engine 22. In one non-limiting example, the feedback signals may include an engine speed, an engine run time, a coolant temperature, an intake air temperature, an exhaust air temperature, an exhaust air composition and the like. Additionally, the feedback signals may include a fuel amount that is metered by the fuel governor 45 and delivered to each cylinder 28 of the internal combustion engine 22.

In a next block 152, the electronic controller 66 may determine an operational condition of the internal combustion engine 22 such as but not limited to, a cold start-up condition, a low load condition, normal condition and the like. For example, the electronic controller 66 may first analyze the engine speed, the engine run time or other such condition to confirm that the internal combustion engine 22 has been started and is currently running. Additionally, the electronic controller 66 may analyze the engine coolant temperature, the intake air temperature or other such feedback signal to determine whether the internal combustion engine 22 may be operating in a cold start-up condition.

If the electronic controller 66 determines the internal combustion engine 22 is operating in a cold start-up condition, then in a next block 154 the electronic controller 66 may execute a cylinder test which can quickly test the performance of the internal combustion engine 22. As discussed above, the electronic controller 66 may be programmed to include the cylinder cutout strategy 90 that executes the testing strategy for the plurality of cylinders 27. In an embodiment, the plurality of cylinders 27 are divided into two patterns and one-half of the plurality of cylinders 27 are assigned to each of the first pattern 80 of cylinders 27 (e.g., cylinders 1, 2 and 3) and the second pattern 82 of cylinders 27 (e.g., cylinders 4, 5 and 6). Moreover, during execution of the testing strategy, the cylinder cutout strategy 90 will select one of the first pattern 80 or second pattern 82 of cylinders 27 to test. The testing strategy will turn off one cylinder at a time within the selected pattern (e.g., first pattern 80 or second pattern 82).

In a next block 156, the cylinder cutout strategy 90 will analyze data collected during the testing strategy and determine the operational condition of the tested cylinders. More specifically, the cylinder cutout strategy 90 will analyze the data to determine whether the individual cylinders in the tested pattern (e.g., first pattern 80 or second pattern 82) were producing power or not. Following the data analysis, in a next block 158, if over one-half of the cylinders in the tested pattern were producing power (i.e., 2 out of 3 cylinders), then the tested pattern of cylinders will be activated and the non-tested pattern of cylinders will be deactivated. Alternatively, if less than one-half of the cylinders in the tested pattern were producing power (i.e., 1 cylinder or less), then the tested pattern of cylinders will be deactivated and the non-tested patter of cylinders with be activated. Such a testing strategy may decrease the overall time it takes to activate and/or deactivate a number of cylinders because only one-half of the total number of cylinders is tested before the cylinder cutout strategy 90 determines which cylinders to activate and/or deactivate.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A cylinder cutout system for an internal combustion engine, the cylinder cutout system comprising:

a plurality of cylinders of the internal combustion engine;

a first pattern of cylinders and a second pattern of cylinders each defined from the plurality of cylinders;

a plurality of fuel injectors operatively coupled with the plurality of cylinders such that each cylinder of the plurality of cylinders includes at least one fuel injector;

a fuel governor operatively coupled with the plurality of fuel injectors and configured to regulate an amount of fuel received by each fuel injector of the plurality of fuel injectors and injected into the plurality of cylinders;

a plurality of sensors operatively coupled to the internal combustion engine and configured to collect a set of engine data;

a controller communicably coupled with the plurality of fuel injectors, the fuel governor and the plurality of sensors, wherein the controller is programmed to detect a start-up condition of the internal combustion engine based on one or more signals included in the set of engine data received from the plurality of sensors, wherein the controller is programmed to execute a cylinder test cycle on at least a portion of the plurality of cylinders based on a positive detection of the start-up condition, wherein the cylinder test cycle includes turning off one cylinder at a time from the portion of the plurality of cylinders to determine if the cylinder is active, and wherein the controller is programmed to activate one of the first pattern of cylinders or the second pattern of cylinders and to deactivate the other one of the first pattern of cylinders or the second pattern of cylinders based on the cylinder test cycle results.

2. The cylinder cutout system of claim 1, wherein the plurality of sensors includes at least one of an engine speed sensor, a fuel sensor, an engine coolant temperature sensor and an inlet air manifold temperature sensor.

3. The cylinder cutout system of claim 1, wherein the controller is programmed to select one of the first pattern of cylinders or the second pattern of cylinders, and wherein the controller executes the cylinder test cycle only on a selected pattern from the first pattern of cylinders or the second pattern of cylinders.

4. The cylinder cutout system of claim 3, wherein the first pattern of cylinders and the second pattern of cylinders are defined to each include one-half of a total number of the plurality of cylinders.

5. The cylinder cutout system of claim 3, wherein the cylinder test cycle turns off one cylinder at a time from the selected first pattern of cylinders or the second pattern of cylinders, and wherein the plurality of sensors continue to collect the set of data during the cylinder test cycle that is further analyzed by the controller.

6. The cylinder cutout system of claim 1, further comprising a wear timer operatively coupled to the plurality of cylinders and communicably coupled to the controller, wherein the controller analyzes a wear time captured by the wear timer for each of the first pattern of cylinders and the second pattern of cylinders, and wherein the controller is further programmed to determine which of the first pattern of cylinders and the second pattern of cylinders has a lower wear time and the controller executes the cylinder test cycle based on the lower wear time.

7. The cylinder cutout system of claim 1, further comprising a cumulative run timer operatively coupled to the plurality of cylinders and communicably coupled to the controller, wherein the controller analyzes a cumulative run time captured by the cumulative run timer for each of the first pattern of cylinders and the second pattern of cylinders, and wherein the controller compares the cumulative run time with a predetermined maximum run time stored in the controller.

8. The cylinder cutout system of claim 7, wherein if the cumulative run time equals the predetermined maximum run time the controller deactivates one of the first pattern of cylinders and the second pattern of cylinders and activates the other one of the first pattern of cylinders and the second pattern of cylinders.

9. A method of controlling a cylinder cutout system for an internal combustion engine including a plurality of cylinders, the method comprising:

receiving one or more feedback signals from a plurality of sensors operatively coupled to the internal combustion engine;

analyzing the feedback signals for one or more engine operating conditions;

determining whether the internal combustion engine is operating in a start-up condition based on analysis of the feedback signals;

testing one of a first pattern of cylinders or a second pattern of cylinders defined from the plurality of cylinders of the internal combustion engine, the testing including turning off one cylinder at a time from the first pattern of cylinders or the second pattern of cylinders to determine if the cylinder is active;

determining an operational condition of the tested first pattern of cylinders or the second pattern of cylinders; and selectively activating one of the first pattern of cylinders or the second pattern of cylinders and deactivating the other one of the first pattern of cylinders or the second pattern of cylinders based on the operational condition determined from the tested first pattern of cylinders or the second pattern of cylinders.

10. The method of controlling the cylinder cutout system of claim 9, wherein the plurality of sensors includes at least one of an engine speed sensor, a fuel sensor, an engine coolant temperature sensor and an inlet air manifold temperature sensor, and wherein analyzing the feedback signals includes analysis of at least one of a engine speed, a fuel flow, an engine coolant temperature and an intake air temperature.

11. The method of controlling the cylinder cutout system of claim 9, wherein testing one of the first pattern of cylinders and the second pattern of cylinders includes selecting either the first pattern of cylinders or the second pattern of cylinders to test, and wherein a cylinder test cycle turns off one cylinder at a time from a selected pattern from the first pattern of cylinders or the second pattern of cylinders.

12. The method of controlling the cylinder cutout system of claim 11, further comprises measuring a wear time collected by a wear timer operatively coupled to the plurality of cylinders, and wherein selecting the first pattern of cylinders or the second pattern of cylinders for a cylinder test cycle includes determining a lower wear time between the first pattern of cylinders and the second pattern of cylinders.

13. The method of controlling the cylinder cutout system of claim 11, further comprises measuring a cumulative run time for each of the first pattern of cylinders and the second pattern of cylinders collected by a cumulative run timer operatively coupled to the plurality of cylinders, wherein the cumulative run time is compared with a predetermined maximum run time.

14. The method of controlling the cylinder cutout system claim 13, wherein if the cumulative run time equals the predetermined maximum run time, the selected first pattern of cylinders or the second pattern of cylinders is deactivated and the other one of the first pattern of cylinders or the second pattern of cylinders is activated.

15. An operational control system for an internal combustion engine including a plurality of cylinders, the operational control system comprising:

a plurality of fuel injectors operatively coupled with the plurality of cylinders such that each cylinder of the plurality of cylinders includes at least one fuel injector;

a fuel governor operatively coupled with the plurality of fuel injectors and configured to regulate an amount of fuel received by each fuel injectors and injected into each cylinder of the plurality of cylinders;

a plurality of sensors, including at least one of an engine speed sensor, a fuel sensor, an engine coolant temperature sensor, and an inlet air manifold temperature sensor, the plurality of sensors are operatively coupled to the internal combustion engine and configured to collect a set of engine data;

a first pattern of cylinders and a second pattern of cylinders each defined from the plurality of cylinders; and a controller communicably coupled with the plurality of fuel injectors, the fuel governor and the plurality of sensors, wherein the controller is programmed to detect a start-up condition of the internal combustion engine based on one or more signals included in the set of engine data received from the plurality of sensors, wherein the controller is programmed to execute a cylinder test cycle on at least a portion of the plurality of cylinders based on a positive detection of the start-up condition, wherein the cylinder test cycle includes turning off one cylinder at a time from the portion of the plurality of cylinders to determine if the cylinder is active, and wherein the controller is programmed to activate one of the first pattern of cylinders and the second pattern of cylinders and to deactivate the remaining one of the first pattern of cylinders or the second pattern of cylinders based on the results of the cylinder test cycle.

16. The operational control system of claim 15, wherein the first pattern of cylinders and the second pattern of cylinders are defined to each include one-half of a total number of the plurality of cylinders, and wherein the controller is programmed to select only one of the first pattern of cylinders or the second pattern of cylinders such that the cylinder test cycle is executed on one-half of the total number of the plurality of cylinders.

17. The operational control system of claim 16, wherein the cylinder test cycle turns off one cylinder at a time from the selected first pattern of cylinders or the second pattern of cylinders, and wherein the plurality of sensors continue to collect the set of data during the cylinder test cycle that is further analyzed by the controller.

18. The operational control system of claim 15, further comprising a wear timer operatively coupled to the plurality of cylinders and communicably coupled to the controller, wherein the controller analyzes a wear time captured by the wear timer for each of the first pattern of cylinders and the second pattern of cylinders, and wherein the controller is further programmed to determine which of the first pattern of cylinders or the second pattern of cylinders has a lower wear time and the controller executes the cylinder test cycle based on the lower wear time.

19. The operational control system of claim 15, further comprising a cumulative run timer operatively coupled to the plurality of cylinders and communicably coupled to the controller, wherein the controller analyzes a cumulative run time captured by the cumulative run timer for each of the first pattern of cylinders and the second pattern of cylinders, and wherein the controller compares the cumulative run time with a predetermined maximum run time stored in the controller.

20. The operational control system of claim 19, wherein if the cumulative run time equals the predetermined maximum run time the controller deactivates one of the first pattern of cylinders and the second pattern of cylinders and activates the other one of the first pattern of cylinders and the second pattern of cylinders.

* * * * *